United States Patent [19]

Barker et al.

[11] 4,233,343

[45] Nov. 11, 1980

[54] THREE-DIMENSIONAL DECORATIVE SURFACE

[75] Inventors: John C. Barker, Cowansville; Ivan P. McLaughlin, Dunham, both of Canada

[73] Assignee: J. J. Barker Company Limited, Quebec, Canada

[21] Appl. No.: 932,548

[22] Filed: Aug. 10, 1978

[51] Int. Cl.[3] ..... B41M 3/00

[52] U.S. Cl. ..... 427/264; 427/262; 427/257; 427/270; 427/302; 427/333

[58] Field of Search ..... 427/257, 264, 270, 302, 427/333, 262, 258; 428/156, 167, 151, 172, 204; 106/2

[56] References Cited

U.S. PATENT DOCUMENTS

| | | | |
|---|---|---|---|
| 1,753,616 | 4/1930 | Mouger | 427/417 |
| 1,872,999 | 8/1932 | McCarthy | 428/203 |
| 2,073,624 | 3/1957 | Casto | 427/417 |
| 2,832,695 | 4/1958 | Compton et al. | 428/172 |
| 3,293,094 | 12/1966 | Nairn et al. | 156/79 |
| 3,600,827 | 8/1971 | Fisher et al. | 35/26 |
| 3,655,421 | 4/1972 | Long | 428/207 |
| 3,677,794 | 7/1972 | Jeff et al. | 428/155 |
| 3,811,915 | 5/1974 | Burrell | 427/262 |
| 4,017,658 | 4/1977 | Bomboire | 428/159 |
| 4,018,957 | 4/1977 | Werner et al. | 428/159 |

*Primary Examiner*—Stanley S. Silverman
*Attorney, Agent, or Firm*—Bacon & Thomas

[57] ABSTRACT

Decorative articles having a three-dimensional patterned surface are formed employing the different surface tension properties of a wet ink printed pattern and a liquid top coat composition; the difference in surface tension is such that the liquid top coat composition retracts from the wet ink pattern; subsequently the ink is dried and the top coat is dried and cured.

12 Claims, 2 Drawing Figures

THREE-DIMENSIONAL DECORATIVE SURFACE

BACKGROUND OF THE INVENTION (a) Field of the Invention

This invention relates to a decorative article having a three-dimensional patterned surface and its manufacture; more especially the invention is concerned with panels having a three-dimensional patterned surface.

(b) Description of Prior Art

Various proposals have been made for the manufacture on a large scale of decorative surfaces simulating surfaces more traditionally produced by craftsmen.

In U.S. Pat. No. 3,811,915, Burrell et al, there is disclosed a three-dimensional simulated wood grain product and its manufacture in which a silicone-containing ink is employed to repel a colourless top coat.

In Canadian Patent No. 981,124, Barker et al there is described the manufacture of a simulated ceramic tile having a contoured surface in which a pattern of dry ink lines of silicone-containing ink is employed to repel a pigment-containing top coat.

SUMMARY OF THE INVENTION

The present invention has an object to provide decorative articles having a three-dimensional patterned surface, which can readily be formed as an integral panel, and which can be readily adhered as a single unit to a wall or other surface to be decorated.

It is a further object of the invention to provide such articles that are lightweight.

It is a further object of the invention to provide a method of producing such decorative articles; and more particularly a method of producing a panel having a three-dimensional patterned surface.

According to the invention there is provided a decorative article having a three-dimensional patterned surface comprising a substrate having a flat surface coated with a coloured printable base; an inked layer comprising a layer of ink lines forming a printed pattern on said printable base and a top coat of a hard resinous film-forming material; said top coat having a variable height thickness defining a contour of valleys, hills and plains; said top coat having a height thickness of less than 1 mil over said ink lines; said ink lines being formed from a wet ink composition and said top coat being formed from a liquid top coat composition; said ink composition and liquid top coat composition having differing surface tension properties effective to establish said contour by retraction of said liquid top coat composition from said wet ink lines.

According to one embodiment of the invention the decorative article is in the form of a panel adapted to be adhered to a wall.

According to another aspect of the invention there is provided a method of producing an article having a three-dimensional patterned surface comprising: coating a flat surface of a substrate with a coloured printable base; printing on said printable base a pattern composed of lines of a wet ink composition; applying to said printable base, over the pattern of wet ink lines, a liquid top coat composition of a resinous film forming material in a volatile, organic solvent; allowing said liquid top coat composition to retract from the wet ink lines to form ridges of the liquid top coat composition adjacent the wet ink lines, and subsequently drying and baking the substrate to dry said ink lines and fix said liquid material as a hard resinous top coat defining a contour of valleys, hills and plains, said top coat remaining on the printed pattern in a thickness less than 1 mil.

In general the ink may be colourless or coloured, although a coloured ink is particularly preferred in many embodiments. When a coloured ink is employed, it forms a clearly visible pattern of coloured ink lines. In this embodiment the top coat thickness of less than 1 mil over the ink pattern is such that the colour of the ink is not obscured.

The liquid top coat must be applied to the inked pattern while the ink is still wet. The liquid top coat and the ink composition are selected to have surface tension effects sufficiently different that the liquid top coat composition retracts from the wet ink lines. The ability of different ink compositions and top coat compositions to meet this requirement can be readily determined by experiment and in general the surface tension properties of one of the compositions can be modified by addition of a solvent. Particularly the liquid top coat composition should have a surface tension property higher than that of the ink. In order to ensure that the ink remains wet after printing it may be appropriate to add a high boiling solvent particularly solvents having a boiling point of at least 350° F., for example, mineral spirits, ethylene glycol monomethyl ether acetate ("Cellosolve" acetate—"Cellosolve" is a trademark of Union Carbide Corp.), and cyclohexanone. Such a solvent will evaporate at room temperature only slowly and thus the ink will remain wet.

It is to be understood that the term "wet" qualifying the ink lines is intended to exclude ink lines which have been fully dried as in the process described in the aforementioned Canadian Patent No. 981,124. The ink lines should be as wet as possible in order to obtain the necessary surface tension effect. As the solvent in the ink volatilizes or evaporates the ink lines will become tacky and eventually dry. In the tacky stage the ink lines may still have sufficient liquid to obtain the surface tension effect, however, generally it is desirable that the ink lines be wet.

In particular it is preferred to apply the liquid top coat composition immediately after the printing with the wet ink composition. Indeed, the desirability of immediately applying the liquid top coat composition avoids the necessity of a separate drying stage, thereby effecting an economy over processes in which the ink is dried. Further, since the separate drying stage for the ink is omitted, there is a saving in the manufacture time which effects a further economy.

A variety of three-dimensional decorative surfaces can be produced in accordance with the invention, in particular simulated ceramic patterns.

The three-dimensional decorative surfaces are suitably formed on panels which can be applied to a wall or other surface to be decorated. In particular the panels may be formed to simulate an array of bathroom or kitchen tiles. In this way a bathroom or kitchen can be tiled by application of panels to the wall by a procedure which is much simpler and less expensive than the application of individual tiles. At the same time, the simulation which can be achieved is very effective.

The liquid top coat composition may be colourless and transparent or may contain a pigment. When producing a ceramic appearance it is especially appropriate to employ a pigment in the top coat composition. In this case the variation in contour from the relatively flat plains sloping up to the hills results in varying colour intensities in the top coat, which forms a part of the ceramic appearance. The top coat may be of a pigmented transparent resinous material, such that the colour of the under-coat in the non-inked, plain areas is visible, the colour varying in intensity in the hill areas and the slopes thereof.

When a pigment is included in the top coat, the three-dimensional effect is especially significant, and this is particularly desirable when a ceramic appearance is desired. However, even if there is no pigment and the top coat is colourless, a discernible three-dimensional appearance and feel is obtained.

The variation in the thickness of a colourless transparent top coat produces different reflections and refractions of the light which enhance and render discernible the three-dimensional contour.

The ink composition may be any conventional printing ink and is suitably one which will not dry rapidly, for example, typical inks dry in 3 to 4 hours in air at room temperature. As indicated above the ink may be colourless or coloured. Coloured inks comprise a viscous to semi-solid suspension of finely divided pigment in a liquid vehicle, and may dry by evaporation of a volatile solvent vehicle, or by oxidation and polymerization of a drying oil or resin.

Particularly preferred inks are those based on alkyds, acrylics and homo and copolymers of vinyl chloride, particularly copolymers of vinyl chloride and vinylbutyl ether, with ketones as the solvent; the pigments for the coloured inks are conventional being typically inorganic oxides and salts of the transition metals; the pigments are selected according to the colour of ink desired.

The inks are selected such that the surface tension properties of the liquid ink composition are sufficiently different from those of the liquid top coat composition to effect the desired retraction of the liquid top coat composition from the wet ink lines.

The ink compositions employed in the invention are free of silicone oil.

The ink pattern of the wet ink composition is suitably composed of ink lines. If whole areas are inked then an uneven retraction of the liquid top coat composition is obtained and the inked areas are not properly defined by ridges of top coat.

It has been found that an ink line width of 1/16 to 3/16 inches in the ink pattern shows good results with a width of 1/8 inches being especially preferred; the lower limit of the width is dictated by the need to have a clearly visible pattern; if the ink lines are too fine the pattern will be less discernible to the eye. The area of the printable base covered by ink lines may represent a relatively small area of the printable base surface this will depend on the nature of the pattern simulated and will generally be from 5 to 30%, typically 10 to 20% of the total area of the printable base.

The liquid top coat composition is suitably a two component composition in which two components which react with one another are mixed shortly before application to the substrate. After application the two components are fully reacted to provide a hard cured resinous coating. In this case it is important that the reactants not react or cure to any significant extent prior to the coating operation. Such two component compositions are well known in the coating art, and curing is typically effected by heat or a catalyst. One such two component composition comprises a polyester and an expoy compound, for example, an oxirane modified ester.

The two component liquid top coat composition is suitably applied to a wet thickness of about 4 to about 5 mils. This thickness of top coat results in ridges or hills, adjacent the wet inked pattern of about 8 mils wet height thickness, which dry to a height thickness of about 4 to 5 mils. The height thickness of the ridges or hills of the top coat is desirably at least about 4 mils to obtain a markedly discernible three-dimensional feel and appearance.

This is especially so when a hand painted ceramic is being simulated. However, with other patterns, less marked three-dimensional appearances may be preferred and in this case a smaller coating thickness, for example, 1 to 2 wet mils may be applied.

Although the liquid top coat retracts from the wet ink pattern a very small coating thickness of top coat may remain on the wet ink pattern, however, this is less than 1 mil in thickness for a coating thickness of 4.5 to 5 mils. When the top coat is pigmented according to the teachings of this invention, it is found that this small residual thickness of top coat over the ink does not obscure the colour of the ink. It is, of course, essential that the pattern of wet ink lines be clearly visible when the top coat retracts from the wet ink pattern.

The liquid top coat composition may be any resinous film-forming material, in a volatile organic vehicle, such resinous materials are well known for producing finishing surfaces of plastic material. Conventional top coat resin compositions are colourless and transparent when used to provide a protective surface over a printed pattern.

In one embodiment the conventional colourless, transparent top coat compositions are employed to produce a three-dimensional contoured surface having an appearance markedly different from the non-contoured, smooth, protective surfaces which are more usually formed from these top coat compositions.

In a second embodiment the present invention represents a departure from the prior systems in that a small amount of pigment is incorporated into the otherwise colourless, transparent resin top coat composition to give it colour and to contrast with the colour in the ink lines and the colour in the under-coat. This is especially advantageous where a hand painted ceramic pattern is to be simulated.

Suitable volatile vehicles include aromatic solvents and glycols; a particularly preferred solvent for the preferred two component resin system, based on polyester resin and oxirane modified ester resin is xylol.

Any pigment compatible with the resin system can be employed in the top coat when a coloured top coat is desired; the particular pigment chosen depends on the colour desired.

When employed, the pigment is present in relatively small amounts to provide colour in the top coat. The lower limit is dictated by the desire to have a discernible colour in the top coat. If there is too little pigment, the top coat will appear colourless; the upper limit depends on the particular colour of the pigment and the colour of areas of the base coat which are not inked, since if the colour in the top coat is too intense it will mask the background colour; and this may be undesirable; this will depend on the particular design. Suitably it is found that 0.75% to 2.0% and preferably about 1.5% by weight of pigment colouring based on the total weight of the liquid top coat composition, is sufficient to produce the ceramic effect, while avoiding the masking of background colours.

The pigments employed in the under coat and the optional pigment in the ink and top coat are selected so that there is a discernible contrast between the three. This may be achieved either by employing completely different colours in the under coat, ink and top coat, or by employing different shades of the same colour, or by employing two different shades of one colour with a completely different colour. For example, when a hand painted ceramic is to be simulated it is especially preferred to use a white pigmented top coat; in this case the under-coat might be a pale blue and the ink lines a deep blue; or the ink lines might be yellow and the under-coat green; a third possibility is that the under-coat, ink lines and top coat could be different shades of the same colour, for example, different shades of blue. It is, of course, important that there be adequate and discernible differentiation in the colours or shades in order to produce a contrast in the colours and provide the desired appearance, for example, a ceramic appearance.

It is found that an especially pleasing appearance is obtained by employing different shades of the same colour for the under-coat and ink lines, in conjunction with a white pigmented top coat, the under-coat being a pale shade and the ink lines being a deep shade of the same colour.

An advantage of employing a white pigmented top coat in this manner is that the colour of the under-coat is observed in different shades, thus enhancing the ceramic appearance in this embodiment. The ridges or hills of the top coat formed are substantially opaque and obliterate the underlying under coat. The top coat between the ridges in the non-inked areas, which forms the plains is only partially opaque or in other words is translucent and the colour of the undercoat is visible therethrough as a lighter shade than the exposed areas of under-coat in the valleys adjacent the ink lines where the top coat is repelled. As indicated previously there may be a very small coating thickness of top coat in the valleys, of less than 1 mil thickness, however, this small thickness is substantially transparent so that coloured ink lines and the under coat adjacent the ink lines are clearly visible.

When a pigment is present in the top coat composition it is instrumental in conjunction with the applied thickness of liquid top coat composition in obtaining the required retraction to expose the wet ink line pattern and the adjacent coloured under-coat, and to provide a resinous top coat which is transparent over the valleys, opaque in the hills and translucent in the plains.

By employing a pigment content of 0.75 to 2.0% by weight in a wet thickness of about 4 to 5 mils the required variation in the top coat can be obtained. If more than about 2.0% by weight of the pigment is employed, then the retraction by surface tension may be affected. It is believed that the weight of the pigment particles slows down the retraction and if the weight of the pigment particles is too high no satisfactory retraction of the liquid top coat composition is obtained. Lowering the viscosity of the liquid top coat composition does not appear to overcome the problem of poor retraction when the pigment content is increased, so that it appears to be the content of pigment particles which is significant.

The pigment content may also be expressed on a volume basis and in this case suitably comprises from 0.2 to 0.5%, preferably about 0.4%, by volume of the liquid top coat composition.

It will be understood that the invention is not restricted to any particular colour combinations and that the term "colour" includes white and black as well as intermediate grey colours in addition to the more conventional spectral colours such as blue and yellow.

The liquid top coat composition for application to the inked substrate suitably has a content of the resinous material of 50% to 70% by weight, with about 65% being preferred. The liquid top coat composition should, of course, remain liquid for a time long enough to allow it to retract from the wet ink by virtue of the differing surface tension properties, and form the ridges.

When the volatile vehicle of a pigmented liquid top coat composition has been volatized the resinous top coat remaining contains about 1 to about 4%, preferably about 2.25 to 2.5%, by weight of pigment, based on the weight of the non-volatile part of the liquid top coat composition.

The top coat may be applied to the substrate by conventional means, for example, spraying or curtain coating, the latter being preferred.

In another embodiment the liquid top coat composition may be based on an alkyd resin and a melamine resin containing an acid catalyst, for example, para-toluene sulphonic acid, which will promote the cure at an elevated temperature.

Alkyd/melamine resin coating compositions are widely employed to provide a colourless, transparent, smooth protective finish on patterned substrates. If they are employed in too great a coating thickness, however, there is a tendency for bubbling of the resin coating which results in blistering and an unacceptable product. This arises from the need for relatively high temperatures to cure the alkyd/melamine top coat composition.

This tendency to blister is especially significant in the present invention in which ridges of the liquid top coat composition are formed. The blistering is especially notable in the ridges where the top coat has its greatest height thickness.

It is found that the blistering is avoided if the alkyd/-melamine liquid top coat composition is applied in a coating thickness of 1 to 2 mils, preferably about 1.5 mils. A wet coating thickness of about 1.5 mils results in ridges of about 3 wet mils thickness. While this lower coating thickness results in a less marked three-dimensional contour it nevertheless is satisfactory for many designs and certainly produces an improved appearance in comparison with the conventional smooth, non-contoured surfaces formed from alkyd/melamine resins.

As indicated previously the liquid top coat composition is applied while the ink pattern is still wet. The liquid top coat composition may be applied at any time while the ink is still wet, however, in a continuous-in-line production it is desirable to apply the top coat composition immediately after the printing with the wet ink as this permits a higher through-put. Most preferably the liquid top coat composition is applied within 25 seconds of the inking stage and will generally be applied 5 to 25 seconds after printing with the wet ink.

When the desired contour is obtained in the top coat it is fixed by evaporation of the solvent, followed by baking to harden the resinous material. The ink is dried by an initial evaporation of the solvent whereafter the ink cures. Evaporation of the solvent from the ink occurs simultaneously with evaporation of solvent from the top coat composition. When the solvent has been evaporated from the top coat composition its retracted position is essentially fixed even though the top coat is not cured. Subsequently the top coat composition is hardened by curing and the ink may also be cured. The curing produces a hard protective finish.

In one embodiment the drying stage comprises exposing the wet top coat and wet ink to a temperature of up to about 200° F. for about 30 seconds; and this drying stage may be followed by a baking at an elevated temperature. The temperature for baking is dependent on the nature of the resin forming ingredients of the top coat composition.

In the case of the two component polyester/epoxy compositions baking at about 250° F. for 2.5 to 3 minutes is appropriate to effect the cure.

In the case of the alkyd/melamine compositions higher temperatures are required typically 300° to 500° F., preferably 350° to 400° F., and most preferably about 450° F., for 1 to 5 minutes, preferably about 2 minutes.

Problems occur in some instances if the drying temperature is above about 200° F. and a temperature of about 140° F. is particularly suitable. If the top coat is heated above about 200° F. during the drying stage in which the solvent is evaporated there is a danger of bubbling and leaching of the colour.

The curing may suitably be carried out in an oven having a plurality of stages in which the temperature increases from the inlet end to the outlet end within the specified range. The use of higher temperatures in the curing stage results in a harder resin coating which is much preferred.

The substrate particularly preferred is a hardboard sheet, although other substrates, for example, particle board can also be used. Non-wood based porous sheets, for example, plaster board or sheets of gypsum can also be employed. It will be evident that the substrate might be selected from a variety of materials which are self-supporting, and in sheet form, with the appropriate physical characteristics.

In a particularly advantageous and preferred embodiment the substrate comprises a hardboard panel 4 ft. by 8 ft. When a plurality of hand painted ceramic tiles is to be simulated there is suitably defined on the panel eight rows of sixteen, six inch square tiles, with a narrow margin between adjacent tiles; or there can be defined twelve rows of twenty-four, four inch square tiles with a narrow margin between adjacent tiles. In this case the narrow margin is defined by the ink layer in the form of ink lines, dividing the panel into six inch squares; or four inch squares; in this way the margin forms a depressed zone or valley corresponding to the depressed zone which occurs between adjacent tiles when conventional tiles are secured to a wall.

There can thus be produced a light-weight panel of 128 tiles or 288, which can be readily secured by adhesive to a wall or other surface to be decorated. In this way a wall can be given a tiled surface far more quickly than when each tile is secured individually on the wall. Furthermore utilizing the panels the wall can be more readily fitted and a full panel can be easily cut to provide an appropriate size panel to complete the covering of the wall. It will be appreciated that these figures are given only by way of example and tiles of different dimensions and panels of a different size could also be employed.

The under-coat for the hardboard substrate is of a conventional kind and serves to seal the pores of the hardboard surface and provide a coloured printable base surface. Conveniently the under-coat may be made up of two separate coatings; a lower fill coat to seal the pores and an upper base coat to provide a coloured printable base. Such coatings are well known in the art and may suitably be applied to the substrate by conventional techniques, for example, roller coating. The fill coat is suitably applied by reverse roller coating and dried in a hot air oven at 150° F. for one minute; advantageously the fill coat surface is sanded to make it smooth before application of the base coat. The base coat is suitably applied by a curtain coater and dried in a hot air oven at about 375° F. for 1.5 to 2 minutes.

While the method has been described in terms of forming a single wet ink pattern, it will be readily understood that additional inking patterns could be employed, with such ink patterns being dried to obtain a multiplicity of colours in the tile. In this case the wet ink layer is applied as the final inking stage. Of course, there will be no retraction of the liquid top coat composition from the dry ink pattern.

The ink patterns can be formed by conventional ink printing techniques where the substrate is not required to be flexible including silk screen printing, and offset roller printing.

BRIEF DESCRIPTION OF DRAWINGS

The invention is illustrated in preferred embodiments by reference to the accompanying drawings in which.

DESCRIPTION OF PREFERRED EMBODIMENTS

Figure 1:
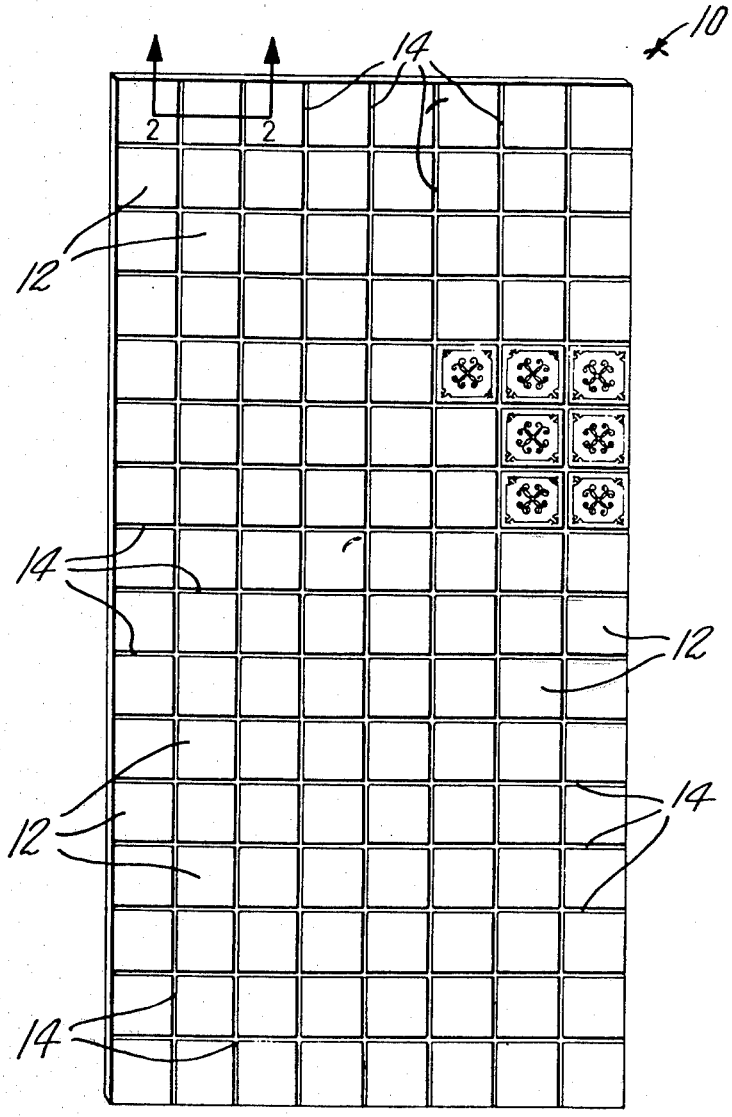
FIG. 1 illustrates schematically a hardboard panel defining a plurality of simulated ceramic tiles.

With reference to FIG. 1 there is illustrated a hardboard panel 10 defining a plurality of simulated ceramic tiles 12, with a narrow inked margin 14 between adjacent tiles 12; a design has been shown on certain of the tiles 12 by way of illustration.

Figure 2:
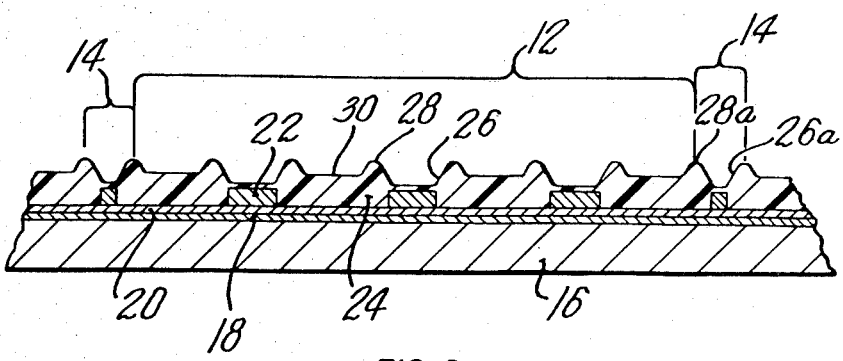
FIG. 2 illustrates a cross-section on the line 2—2 of FIG. 1.

With reference to FIG. 2 there is illustrated a cross-section of a tile 12 comprising a hardboard substrate 16 defined by a portion of the panel 10 of FIG. 1; a sanded fill coat 18 and coloured base coat 20. An ink pattern of inked portions 22 is printed on base coat 20, the inked portion 22 comprises lines of ink. A hard top coat 24, optionally containing a pigment, provides a contoured surface defining valleys 26 over inked portions 22; hills 28 adjacent inked portions 22 and plains 30 between hills 28. The tile 12 terminates at a hill **28*a* sloping into a valley 26*a* over inked margin 14**.

This invention is illustrated by reference to the following Examples which are not to be construed as limiting.

EXAMPLE 1

In the laboratory a sheet of hardboard 6 inches by 12 inches was roller coated with a fill coat of formulation A below. The fill coat was dried in a hot air oven at 150° F. for one minute and the resulting coated surface was sanded to provide a smooth surface which was then curtain coated with a base coat of formulation B below, the base coat was dried in a hot air oven at 375° F. for 2 minutes.

The resulting base coat was printed with a pattern of ink lines using a silk screen with an ink of formulation C below. Within 30 seconds of formation of the ink pattern, and while the ink was still wet there was applied by drawdown a liquid top coat composition D in a thickness of 4 wet mils.

The liquid top coat composition retracted from the wet ink pattern in 10 to 15 seconds.

The top coat was cured in an oven at 250° to 300° F. for 3 minutes. There was no difficulty in the curing and no blistering.

The resulting product displayed good pattern formation with ridges of top coat adjacent the inked pattern.

EXAMPLE 2

A sheet of hardboard 6 inches by 12 inches was treated with formulations A, B and C, in the same manner as in Example 1.

Within 30 seconds of formation of the ink pattern, and while the ink was still wet, there was applied by drawdown a liquid top coat composition E (alkyd/melamine) in a thickness of 4 wet mils.

The liquid top coat composition retracted from the wet ink pattern in 10 to 15 seconds.

The top coat was cured in an oven at 400° F. for 2.5 minutes.

Good pattern formation and three-dimensional effect were obtained. However, blistering occurred in the ridges and bubbling of the top coat was observed during the curing, so that the finished article was not commercially acceptable.

EXAMPLE 3

The procedure of Example 2 was repeated but the liquid top coat composition E was applied in a thickness of 3 wet mils.

As in Example 2, pattern formation was good, although the three-dimensional effect was less pronounced. Fine bubbling was observed during the curing and there was some blistering, although less than in Example 2.

EXAMPLE 4

The procedure of Example 2 was repeated but the liquid top coat composition E was applied in a thickness of 1.5 to 2 wet mils.

Good pattern formation was obtained, no bubbling was observed during curing and there were no blisters in the finished article. The three dimensional effect was much less pronounced but still discernible.

EXAMPLE 5

On a production-line, a hardboard sheet 4 ft. by 8 ft. was treated with formulations A and B under the same conditions as in Example 1.

The resulting base was printed by gravure rolls with the ink of formulation C which was thinned for printing consistency to 45 soc. 4 Ford Cup, by addition of mineral spirits.

Within 25 seconds and while the ink pattern was still wet, there was applied by a curtain coater a liquid top coat composition D in a thickness of 4 wet mils.

The liquid top coat composition retracted in 15 seconds.

The panel was passed into an oven in which the temperature ranged from 250° F. at the inlet to 300° F. at the outlet, for a residence time of 3.25 minutes to effect cure of the top coat.

The resulting product displayed good pattern formation and three dimensional effect.

EXAMPLES 6 TO 9

Examples 1 to 4 were repeated but using an acrylic type ink of formulation F instead of the ink of formulation C. The results were, in each case, the same.

| | |
|---|---|
| Formulation A | |
| A 34 gallon quantity was made up of - | |
| *Beckosol 12-006 (phenolated, phthalic free resin modified alkyd resin available from Reichhold Chemical Inc.) | 150 lbs |
| Barytes (barium sulphate)X5R* available from Canadian Titanium Co. | 430 lbs |
| Tioxide RHD-3* (titanium dioxide pigment available from Tioxide of Canada Ltd.) | 120 lbs |
| Super Hi-Flash*, a naphtha aromatic solvent available from Camsco Solvents & Chemical Co. Ltd. | 54 lbs |
| Cellosolve* Acetate (mono and dialkyl ethers of ethylene glycol - Union Carbide Chemical Corp.) | 5.7 lbs |
| Lead Nuodex* | 1 lb 14 oz |
| Manganese Nuodex* | 12½ oz |
| Cobalt Nuodex* (metal soaps of organic acids available from Nuodex Products Co. Ltd.) | 1 lb 9 oz |
| Formulation B | |
| A 264 gallon quantity was made up of - | |
| Tioxide RHD-3* (T . $O_2$ - Tioxide of Canada Ltd.) | 630 lbs |
| Blancfixe* (a precipitated barium sulphate extender pigment available from Prescott Co. Ltd.) | 1,722 lbs |
| Dry Ultra Marine Blue | 15 oz |
| Aroplaz EP-1537-1* (alkyd resin in a solvent available from Ashland Oil Canada Ltd.) | 930 lbs |
| Xylol | 252 lbs |
| Toluol | 150 lbs |
| The above was ground and mixed well. | |
| Triethylamine | 1 lb 5 oz |
| Resimene U-901* (A melamine and urea formaldehyde resin in organic liquid solvent) | 378 lbs |
| Resimene 875* (available from Monsanto Chemicals Ltd.) (A melamine and urea formaldehyde resin in organic liquid solvent) | 51 lbs |
| Toluol | 102 lbs |
| Formulation C | |
| An alkyd base green ink was made up of the following ingredients - | |
| Chrome Yellow No. 1091 (a lead chromate pigment - Reed Pigment Ltd.) | 2 lbs |
| Thalo Green No. 9140 (Hoechst Chemicals & Dyestuffs Ltd.) | 2 lbs |
| Glyptal No. 2J02 (trademark of General Electric Co. for an alkyd-type polymer and plasticizer) | 50 lbs |
| Cobalt Nuodex 6% (Nuodex is a trademark for metal soaps of organic acids - Nuodex Products Co. Ltd.) | 0.15 lbs |
| Lead Nuodex 27% (trademark) | 0.5 lbs |
| Calcium Nuodex 4% (trademark) | 0.75 lbs |
| Formulation D | |
| A two component liquid top coat composition was obtained by mixing components (a) and (b) in a 1:1 ratio by volume | |
| (a) Aroflint 607 (trademark of Ashland Oil Canada Ltd. for a polyester resin) | 581 lbs |

-continued

| | |
|---|---|
| Xylol | 125 lbs |
| Cellusolve acetate (trademark of Union Carbide Corp. for ethylene glycol monomethyl ether acetate) | 75 lbs |
| White Colourant T-3104 (titanium dioxide colour of J. J. Barker Co., Ltd.) | 46.75 lbs |
| Slip-Aid* No. S1-50 (polyethylene dispersion from Lomas Chemicals Ltd.) | 81 lbs |
| (b) Aroflint No. 404 XA7-60 (trademark of Ashland Oil Canada Ltd. for an oxirane modified ester resin) | 1,080 lbs |
| Formulation E | |
| A one component alkyd/melamine top coat was made up of the following ingredients - | |
| Resimene No. 747 (trademark of Monsanto Chemicals Ltd.) | 105 lbs |
| n-Butyl Alcohol | 80 lbs |
| Catalyst No. 4040* (p-toluene sulphonic acid from Cyanamid of Canada Ltd.) | 6.5 lbs |
| Aroplaz No. 6029 X 60* (oil free alkyd from Ashland Chemicals of Canada Ltd.) | 536 lbs |
| Xylol | 60 lbs |
| Formulation F | |
| An acrylic ink was made up of the following ingredients - | |
| Chrome Yellow No. 1091 | 2 lbs |
| Thalo Green No. 9140 | 2 lbs |
| Acrylic B-6THT (acrylic ester - Rohm & Haas Co.) | 60 lbs |
| Camsco No. 120 (trademark for mineral spirits - Union Carbide Chemical Corp.) | 5 lbs |

*trademark

We claim:

1. A method of producing an article having a three-dimensional patterned surface comprising:

coating a flat surface of a substrate with a coloured printable base;

printing on said printable base a pattern composed of lines of a wet ink composition free of silicone oil;

applying to said printable base, over the pattern of wet ink lines, a liquid top coat composition of a resinous film forming material in a volatile organic solvent; said wet ink composition and said liquid top coat composition having differing surface tension properties such that said liquid top coat composition will retract from said wet ink lines;

allowing said liquid top coat composition to retract from the wet ink lines to form ridges of the liquid top coat composition adjacent the wet ink lines, and subsequently;

drying and baking the substrate to dry said ink lines and fix said liquid material as a hard resinous top coat defining a contour of valleys, hills and plains, said top coat remaining on the printed pattern in a thickness less than 1 mil.

2. A method according to claim 1, wherein said liquid top coat composition has a content of resinous material of 50% to 70%, by weight.

3. A method according to claim 2, wherein said liquid top coat composition contains 0.75 to 2.0%, by weight, of a pigment and said liquid top coat composition is applied in a wet coating thickness of 4 to 5 mils.

4. A method according to claim 3, wherein said drying comprises exposing the liquid top coat composition and wet ink pattern to a temperature up to about 200° F. to evaporate the solvent.

5. A method according to claim 4, wherein said baking comprises exposing the top coat composition to a temperature of about 250° F. for 2.5 to 3 minutes.

6. A method according to claim 5, wherein said top coat is derived from a polyester resin and an oxirane modified ester resin.

7. A method according to claim 1, wherein said liquid top coat is colourless and transparent.

8. A method according to claim 1, wherein said top coat is derived from an alkyd resin and melamine resin and is applied in a wet coating thickness of 1 to 2 mils; said drying comprises exposing the liquid top coat composition and the wet ink pattern to a temperature up to about 200° F. to evaporate the solvent; and said backing comprises exposing the top coat composition to a temperature of 300° to 500° F. for 1 to 5 minutes.

9. A method according to claim 1, wherein said liquid top coat composition has a surface tension greater than said wet ink composition.

10. A method according to claim 1, wherein said ink composition is colourless.

11. A method according to claim 1, wherein said ink composition is coloured and said top coat thickness remaining on the printed pattern is such that the colour of the ink is not obscured.

12. A method according to claim 1, wherein said pattern of lines comprises wet ink lines having an ink line width of 1/16 to 3/16 inches.

* * * * *